US006796829B1

(12) United States Patent
McCarthy

(10) Patent No.: US 6,796,829 B1
(45) Date of Patent: Sep. 28, 2004

(54) ELECTRICAL CONNECTOR APPARATUS AND METHOD

(75) Inventor: Dale C. McCarthy, Pensacola, FL (US)

(73) Assignee: Centerpin Technology, Inc., Pensacola, FL (US)

( * ) Notice: Subject to any disclaimer, the term of this patent is extended or adjusted under 35 U.S.C. 154(b) by 0 days.

(21) Appl. No.: 09/518,650

(22) Filed: Mar. 3, 2000

(51) Int. Cl.[7] ..... H01R 11/20
(52) U.S. Cl. ..... 439/394; 439/584
(58) Field of Search ..... 439/394, 583, 439/584, 461, 462, 578

(56) References Cited

U.S. PATENT DOCUMENTS

| | | | | |
|---|---|---|---|---|
| 3,683,320 A | | 8/1972 | Woods et al. | |
| 3,744,007 A | * | 7/1973 | Horak | 339/97 |
| 4,408,822 A | * | 10/1983 | Nikitas | 339/177 |
| 4,739,126 A | | 4/1988 | Gutter et al. | |
| 5,052,946 A | | 10/1991 | Homolka | |
| 5,066,248 A | * | 11/1991 | Gaver, Jr. et al. | 439/578 |
| 5,318,458 A | * | 6/1994 | Thorner | 439/427 |
| 5,573,423 A | | 11/1996 | Lin et al. | |
| 5,607,320 A | * | 3/1997 | Wright | 439/394 |
| 5,913,694 A | * | 6/1999 | Wright | 439/394 |
| 5,934,937 A | | 8/1999 | McCarthy | |
| 5,934,943 A | | 8/1999 | McCarthy | |
| RE36,700 E | * | 5/2000 | McCarthy | 439/427 |
| 6,102,737 A | * | 8/2000 | Gohdes | 439/583 |
| 6,109,694 A | * | 8/2000 | Kurtz | 297/320 |
| 6,123,567 A | * | 9/2000 | McCarthy | 439/427 |
| 6,126,491 A | | 10/2000 | McCarthy | |
| 6,244,892 B1 | | 6/2001 | McCarthy | |
| 6,062,897 A1 | | 8/2003 | Esser et al. | |

FOREIGN PATENT DOCUMENTS

| | | |
|---|---|---|
| DE | 1921200 | 11/1970 |
| GB | 1109914 | 4/1968 |
| GB | 2300765 | 11/1996 |
| WO | 97/34340 | 9/1997 |

* cited by examiner

*Primary Examiner*—P. Austin Bradley
*Assistant Examiner*—Edwin A. Leon
(74) *Attorney, Agent, or Firm*—Jefferson Perkins Daspin & Aument, L.P.

(57) ABSTRACT

The subject invention relates to an electrical connector for coupling to an insulated single conductor electrical cable or to a coaxial cable, the latter being of the type having an inner conductor enclosed in an inner concentric insulation and having a generally concentric conductive sheath therearound and an outer insulation enclosing the conductive sheath. The subject connector includes a housing having an electrically conductive portion and a bore therein. One or more conductive arms can be disposed in the bore and electrically connected to the conductive housing portion and have pointed ends sized for piercing the outer insulation of the insulated electrical conductor. A closure member is included for closing the open end of the above and for forcing and/or securing engagement of the pointed ends of the conductive arms through the outer insulation of an electrical cable. For embodiments for use with a coaxial cable, the conductive arms are insulated from the electrical conductive pin and the pointed ends of the conductive arms can be shaped relative to one another to pierce the outer insulation and the conductive sheath of the cable without contacting the center conductor.

25 Claims, 9 Drawing Sheets

ELECTRICAL CONNECTOR APPARATUS AND METHOD

BACKGROUND OF THE INVENTION

The present invention relates to electrical connectors. In specific embodiments the invention pertains to an electrical connector for coupling to an insulated single conductor electrical cable or to a coaxial cable.

Typically, in installing single conductor cable including a central conductor with an outer insulation, the end of the wire is stripped of insulation and the bare wire is inserted into a connector where it is soldered, clamped or otherwise attached to the connector. Similarly, with coaxial cables which include a central conductor enclosed in an inner concentric insulation covered by a concentric conductive sheath and encased in an outer insulation, the common practice is to strip the outer insulation to expose the conductive sheath.

It is an object of the present invention to provide an improved electrical connector and method for mechanically coupling and for electrically coupling an insulated electrical cable to an electrical connector without the need for stripping the insulation from the cable.

BRIEF SUMMARY OF THE INVENTION

The subject invention pertains to an electrical connector having a housing with a central bore for receiving an electrical cable, one or more clamping members having inwardly pointed ends in the bore and a closure member for insertion into the bore for closing the bore and for driving the pointed ends of the clamping members into mechanical connection with the electrical cable.

In application to a single conductor cable, the pointed ends of the clamping members may make mechanical connection to the cable and alternatively make electrical connection between the housing and the conductor of the cable. In application to a coaxial cable the pointed ends of the clamping members may make mechanical connection to the cable and electrical connection between the housing and the concentric sheath of the cable.

The closure member or end cap is moveable longitudinally into the bore of the housing and engages, at its outer periphery, the inner periphery of the bore. In its longitudinal movement into the bore it engages the ends of the clamping members to drive the ends radially into the electrical cable. The longitudinal movement of the end cap may be by way of threaded rational movement or by the application of a longitudinally directed force.

The electrical connector of the invention may be provided with a center pin or prong for making an electrical connection beyond the connector, and may be provided with a mounting therefor, which extends the prong into the bore of the housing to make electrical contact with the central conductor of the cable. Alternatively, the housing may include a central guide and aperture which would permit the central conductor of a cable stripped of its insulation to extend appositely beyond the bore of the housing for making electrical connection beyond the connector.

DETAILED DISCLOSURE OF THE INVENTION

Figure 1:
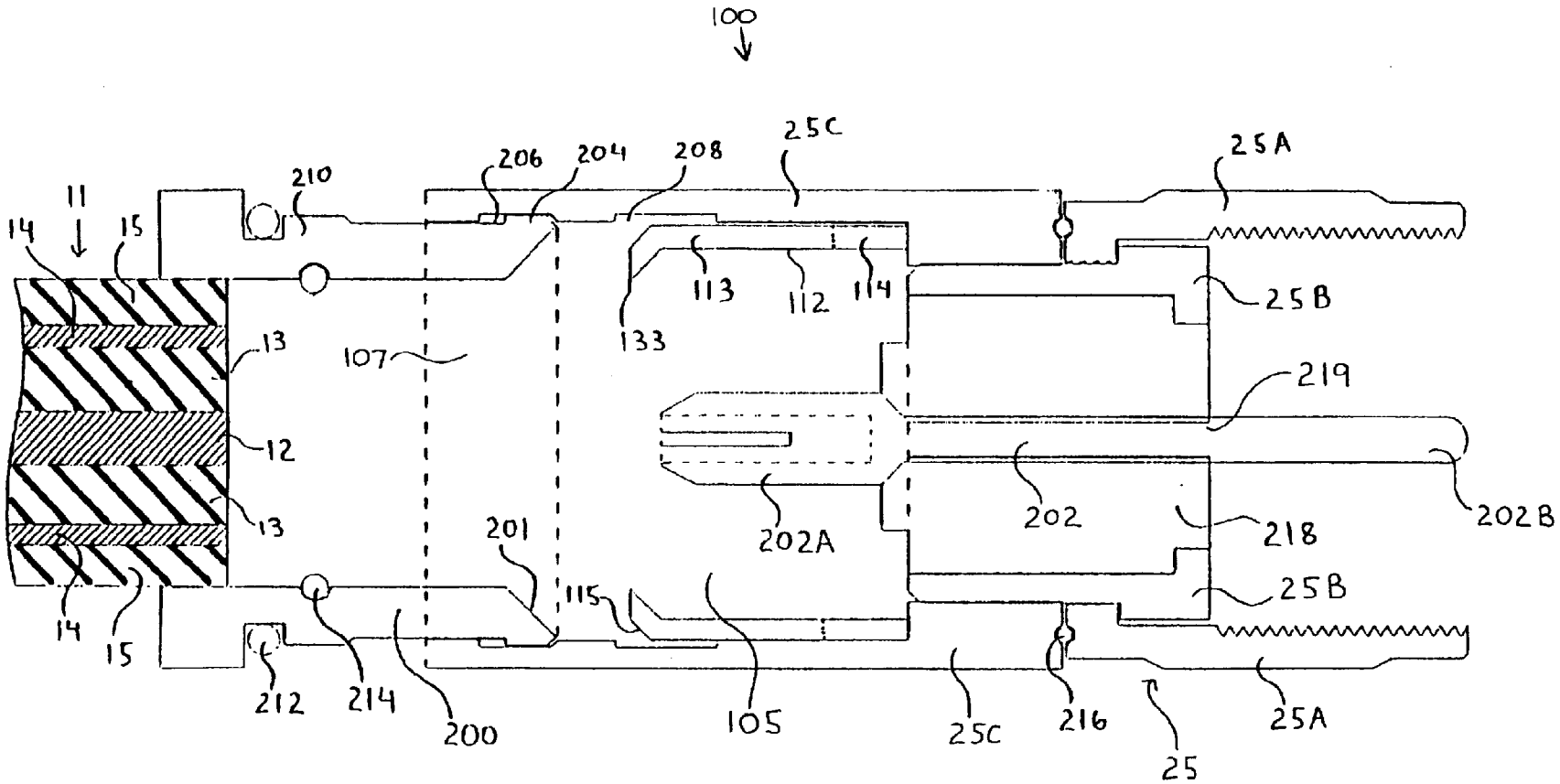
FIG. 1 shows a specific embodiment of an electrical connector in accordance with the subject invention for use with a coaxial cable type insulated electrical conductor.

Referring to FIG. 1, an electrical connector 100 in accordance with the subject invention is shown for use with a coaxial cable 11 having a single solid or braided conductor 12, a concentric insulation layer 13, a conductive sheath 14 and an outer insulation 15. Connector 100 has a housing 25 made up of a rotatable terminal section 25A, an interconnecting section 25B and a housing section 25C, which are in electrical contact with each other. Housing sections 25A, 25B, and 25C can be generally cylindrical in shape and designed such that section 25B holds section 25A in place and makes an interference fit with section 25C. Section 25A can rotate relative to sections 25B and 25C about the axis of the connector, which allows section 25A to be threaded onto a counterpart connector. Alternatively, section 25A can be fixed such that all three sections 25A, 25B, and 25C form a single integral housing 25. In this case, the section 25A can slide onto counterpart connectors rather than being threaded.

Housing section 25C can have a central bore 105 with an open end 107. A conductive clamp 112 can be disposed within the bore. Conductive clamp 112 can be generally cylindrical in shape and include a collar portion 114 and one or more clamping arms 113 extending from collar portion 114. Preferably, the outer periphery of collar portion 114 is approximately the dimension of the inner periphery of bore 105. Collar portion 114 can support clamping arm(s) 113 in longitudinal extension toward open end 107 of bore 105. Clamping arm 113 can have a beveled edge 115 directed radially inward and which can be contacted to urge tip 133 radially inward. The clamping arm(s) 113 can make electrically conductive contact with the housing section 25C, for example, through collar 114. Alternatively clamping arm(s) 113 can be made integral with electrically conductive 25C and/or 25B.

The opposite end of the bore 105 can be closed by a plug 218 of electrical insulating material that can be secured in the interconnecting section 25B by a pressure fit or adhesive or other means, and has in it a central aperture 219 which communicates between the bore 105 and the open space of terminal section 25A. In the configuration of FIG. 1, an electrically conductive pin 202 can be secured in the central aperture 219 with its head portion 202A projecting into bore 105 and its terminal portion 202B projecting into the open space of section 25A. The head portion 202A may be of a split pin type as illustrated but may also be of the solid pin type such as the terminal portion 202B as electrical connection conditions may dictate.

A closure member or end cap 200 of strong and resilient material such as plastic, nylon, rubber, brass or metal can be disposed in the open end 107 of the housing section 25C. Cap 200 is preferably of an internal diameter to receive a cable for connection, shown to be a coaxial cable 11 in FIG. 1.

FIG. 1 shows cap 200 positioned just inside housing 25 where protrusion 204 on cap 200 resides in indentation 206 of housing section 25C. The interaction of protrusion 204 and indentation 206 can hold cap 200 in position, allowing the connector to be held as a single unit prior to attachment to the end of a coaxial cable.

Accordingly, with the end of a coaxial conductor 11 inserted through cap 200 and into housing section 25, the cable can then be pushed further into housing 25 where the hollow pin 202 penetrates the end of the coaxial cable between the center conductor 12 of the cable and insulation layer 13, making electrical contact between the center conductor 12 and pin 202. Cap 200 can include a beveled edge 201 the end of the cap which enters open end 107 of the housing. Beveled edge 201 can be complimentary to beveled edge 115 of the clamping arm 3.

Once the electrical contact has been made between pin 202 and the center conductor of the coaxial cable, cap 200 can be pushed further into housing section 25C. Pushing cap 200 into housing section 25C can, by action of beveled edge 201 of cap 200 operating on beveled edge 115 of clamping arm(s) 113, push clamping arm(s) 113 toward the coaxial cable causing tips 133 of clamping arms 113 to penetrate and pass through outer insulation layer 15 of coaxial cable 11 and make electrical contact with outer conductor 14 of coaxial cable 11. As cap 200 is pushed further into housing section 25C, protrusion 204 interacts with indentation 208 and/or protrusion 210 interacts with indentation 206. The interaction of protrusion 210 and indentation 206 and/or protrusion 204 and indentation 208 can act to hold cap 20 securely in place inside housing 25. Alternatively, if desired, cap 200 can be separate from the housing and slipped onto the end of the coaxial cable prior to the end of coaxial cable being inserted into housing section 25C. Cap 200 can then be slid down the coaxial cable and pushed into housing section 25C Thus by cooperative action between the housing section 25, the end cap 200 and the clamping arm(s) 113, the cable 11 is securely attached mechanically to the connector 100 and in addition the clamping arm(s) 113 complete electrical contact between the outer conductor 14 of the cable and the housing 25 of the connector 100. Additionally, with respect to the embodiment shown in FIG. 1, electrical contact is made with the center conductor 12 and pin 202 of connector 100 which is electrically insulated from the electrical connection made between the conductor 14 and the housing 25 of connector 100.

Preferably, the subject connector is designed to resist the entry of moisture. For example, it is preferred to prevent moisture at the point of penetration of clamping arms 113 into the coaxial cable and at the end of the coaxial cable. Accordingly, O-ring seals 212, 214 and/or 216 can be utilized to reduce or prevent moisture at these sensitive areas.

Preferably, the tolerances of the inner diameter of housing section 25C, the thickness of cap 200, and the dimensions of the coaxial cable and its outer insulation are such that the penetration depth of the tip of the clamping arm 113 into the coaxial cable can be controlled. Such control of the penetration depth can be used to optimize the electrical contact between the clamping arms 113 and the housing, the impact the clamping arms have on the structure of the coaxial cable, and the friction created between the cap 200 and the coaxial cable.

Clamping arms 113 instead of being located in section 25C prior to the insertion of the end of the insulated conductor into section 25C, can be attached to the end of a coaxial cable prior to insertion of the end of the coaxial cable into housing section 25C. For example, a user can align collar 114 and clamping arms 113 on the end of a coaxial cable and then press the tips 133 of clamping arms 113 into the side of the coaxial cable by hand, with pliers, or with some other mechanism. The end of the coaxial cable can then be inserted into housing section 25C and cap 200 inserted into housing section 25C. In this embodiment, cap 200 need not necessarily press the clamping arms 113 into the coaxial cable, but preferably reaches far enough into housing section 25C to hold clamping arms in place with respect to the coaxial cable. In this case, the front of cap 200 need not have a beveled front edge.

In a further alternative embodiment, a tool might be used to push tips 133 of clamping arms 113 into the outer insulation of the coaxial cable prior to the insertion of cap 200 into housing section 25C. Such a tool can slide into housing 25C and urge clamping arms 113 into the side of the insulated electrical conductor. In this embodiment, the beveled edge of cap 200 can have a different shape, as the cap would not necessarily be responsible for pushing the tips of clamping arm 113 into the coaxial. The cap 200 can still be useful for holding the clamping arms in position.

Figure 2:
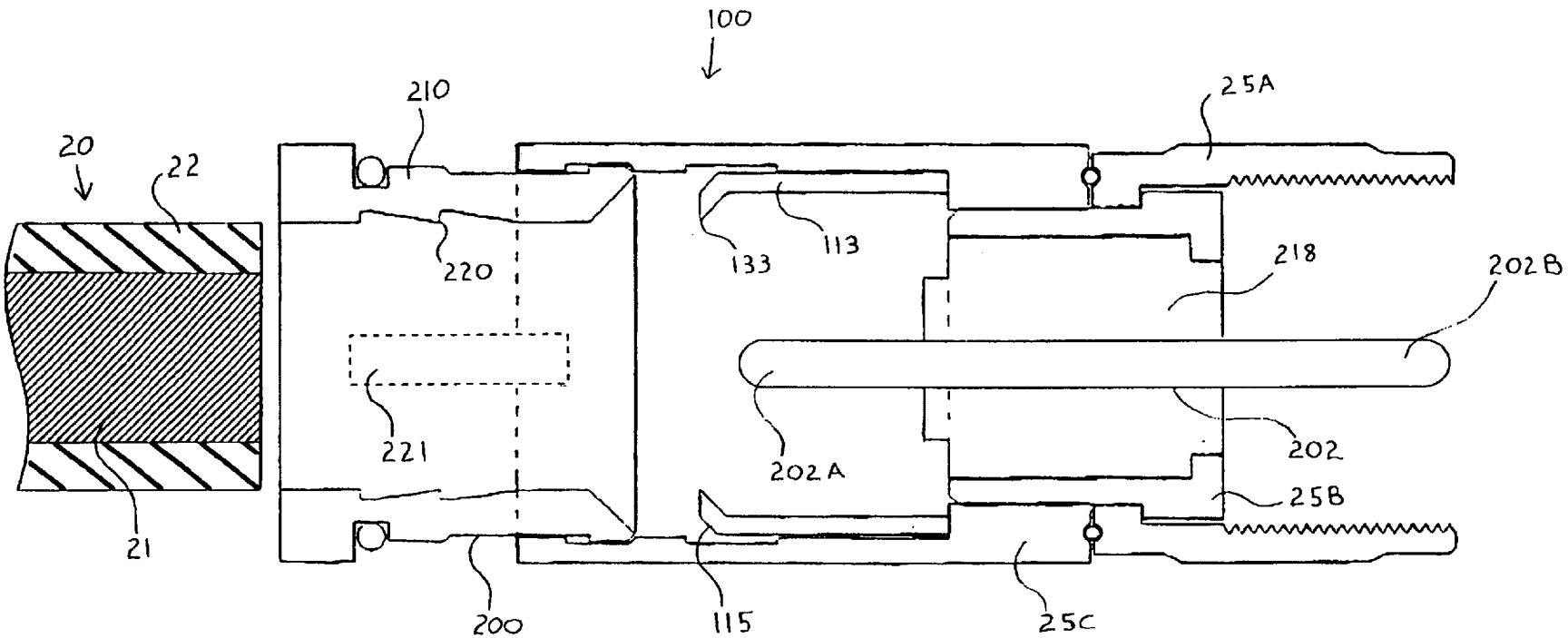
FIG. 2 shows a specific embodiment of an electrical connector in accordance with the subject invention, incorporating an endcap having one or more protrusions.

FIG. 2 shows a variation of the connector 100 of FIG. 1, wherein the conductive pin 202 is shown to have a head portion 202A which is of the solid pin type rather than a split pin type and wherein the cap 200 is modified to include one or more slots 221 in the side wall and an inner circumferential ridge 220 spaced intermediate the ends of the slot 221. The head portion 202A is illustrated as a solid pin type adapted for piercing either the stranded electrical conductor 21 of a single conductor cable 20 as shown or a stranded center conductor of a coaxial cable. Head portion 202A can also make electrical contact with a solid center conductor of a coaxial cable. The purpose of the slot 221 and ridge 220 is to provide a stress relief area around the circumference of the end cap 200. Accordingly, when the cable 20 is in place in the connector engaging the conductive pin 202 and the cap 200 has been pushed in to seat the conductive arms 113 in the outer wall 22 of the cable, further longitudinal pressure on the end of the cap causes the side wall of the cap 200 to move inwardly along the ridge 220 thereby applying clamping pressure to outer wall 22 of the cable 20 to further mechanically secure the cable in place in the connector. The use of the slotted end cap with a single conductor cable is merely illustrative and may be used advantageously with coaxial cables.

Figure 3A:
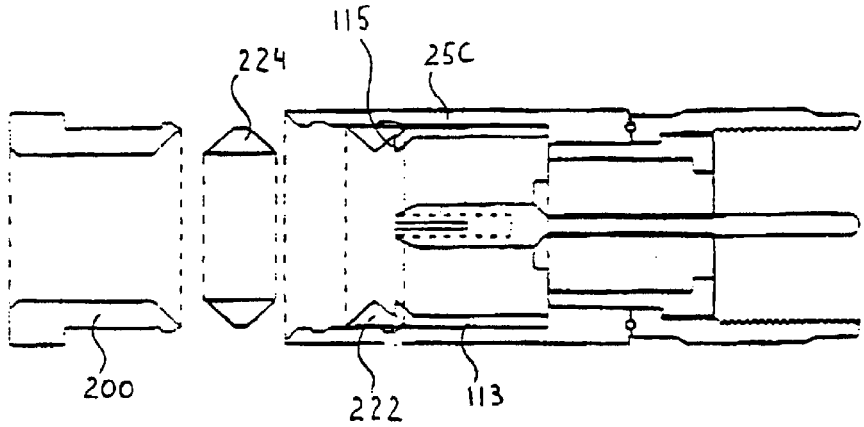
FIG. 3A shows an embodiment of the subject electrical connector, which incorporates a beveled ring and a compression ring.
Figure 3B:
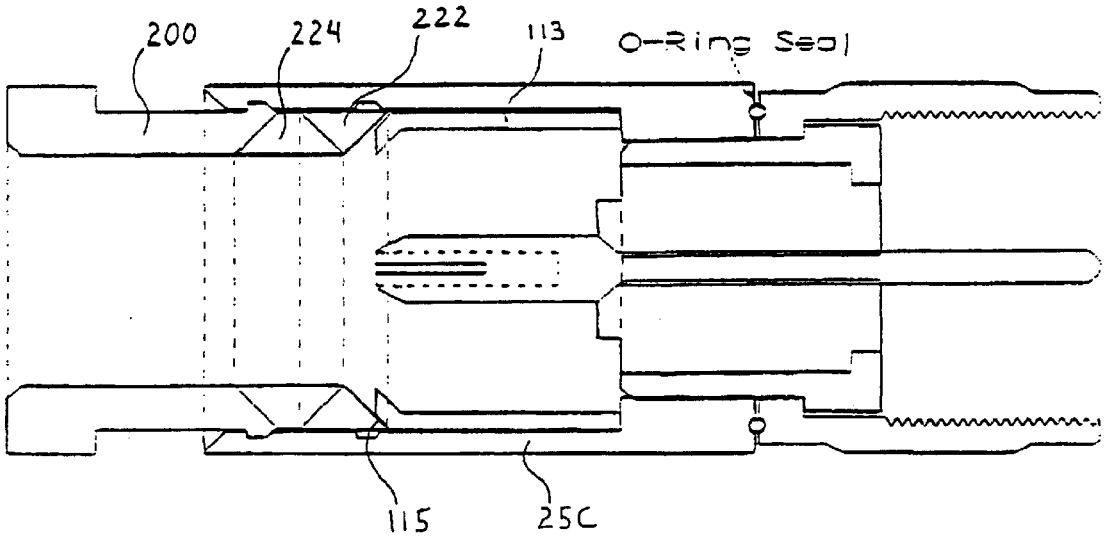
FIG. 3B shows the electrical connector of FIG. 3A after insertion of the cap into the housing.

FIG. 3A is an expanded view and FIG. 3B is an assembled view of another embodiment of the invention of FIG. 1 which includes a double beveled ring 222 and a compression fitting ring 224 to provide additional gripping action on a cable inserted in the connector. Beveled ring 222 is positioned in the housing section 25C such that a first beveled edge contact the beveled edge 115 of the clamping arms 113. Compression ring 224 can then be placed into housing section 25C such that compression ring 224 contacts the other edge of the beveled ring 222. When cap 200 is forced into housing section 25C it pushes compression ring 224 into beveled ring 222 which in turn forces clamping arms 113 radially inward to engage a cable inserted in the housing section. The ring 222 comes to rest and the compression ring 222, compressed between cap 200 and beveled ring 222 is forced radially inward against the coaxial cable to further grip the coaxial cable and hold it in place.

Figure 3C:
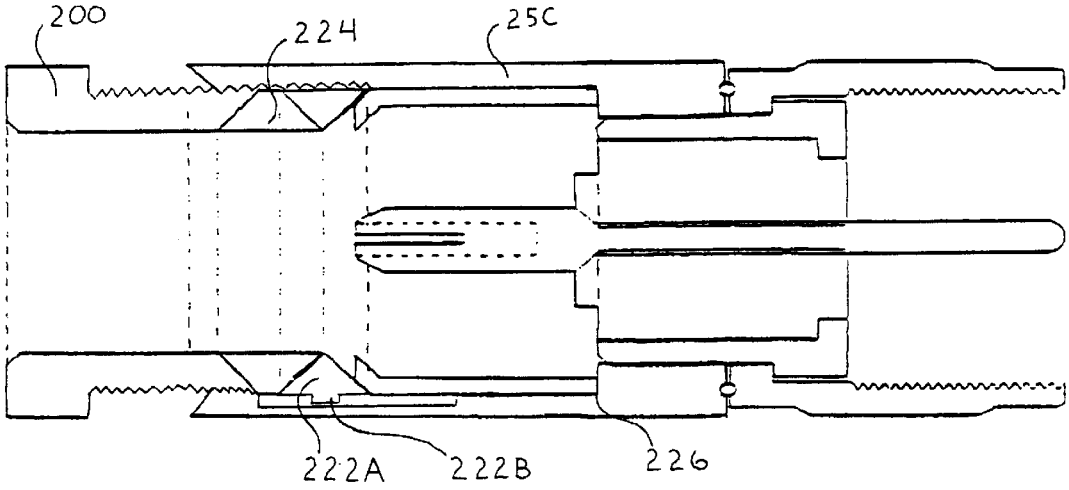
FIG. 3C shows the electrical connector of FIG. 3A incorporating a key and groove to prevent the beveled ring from rotating with respect to the housing.

FIG. 3C is a variation of the embodiment of FIGS. 3A and 3B in which the end cap 200 and the housing section 25C are threaded for rotational longitudinal movement instead of sliding longitudinal movement. In this embodiment the beveled ring 222A is keyed with a discrete protrusion 222B which fits into a longitudinal slot 226 in the housing 25C to prevent rotation of the ring against the surface 115 of the clamping arm(s) 113. In other respects the embodiment operates in the same manner as that of FIGS. 3A and 3B.

Figure 4:
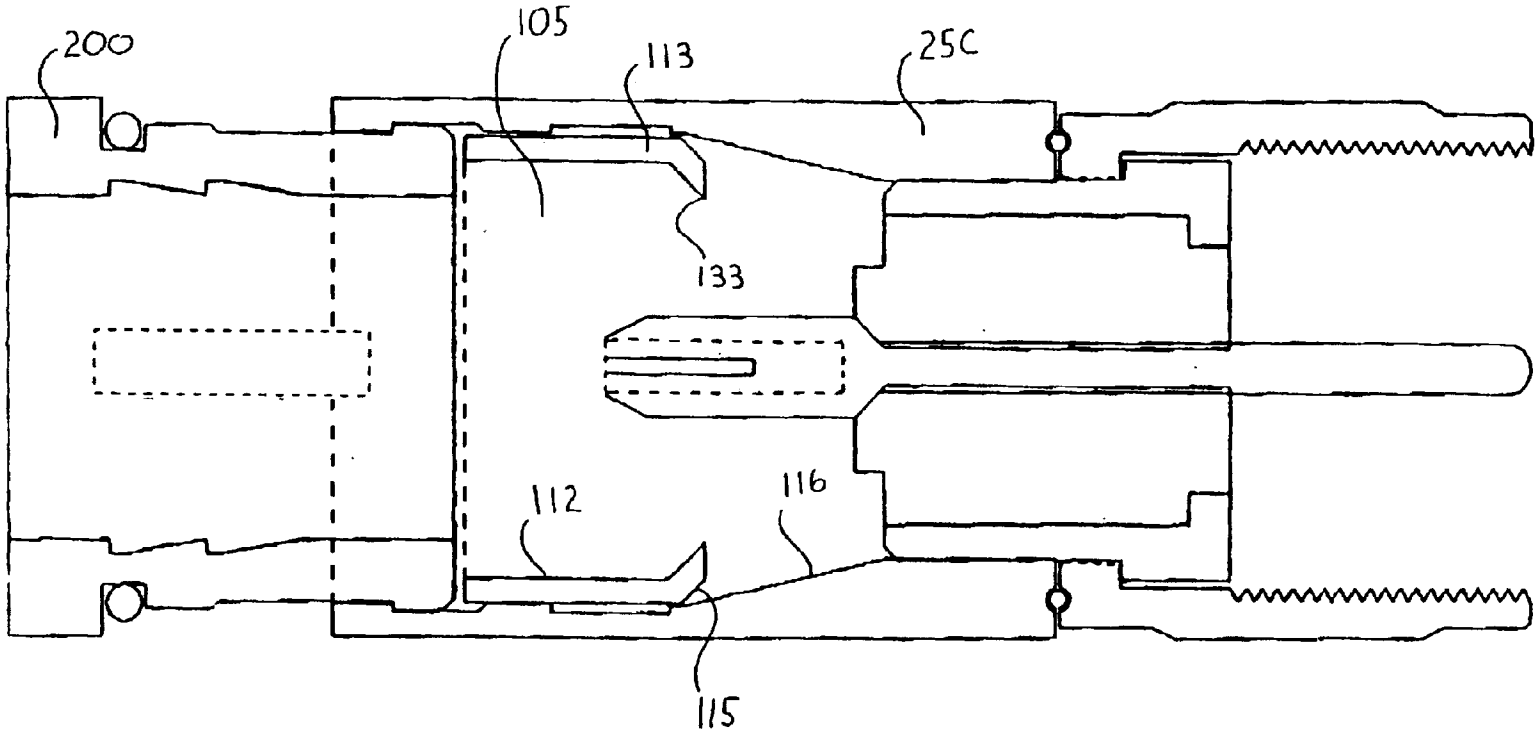
FIG. 4 shows an embodiment of the subject invention where clamping arms extend toward the end of the insulated electrical conductor.

In the embodiment of FIG. 4, the position of the conductive clamp 112 has been reversed from that shown in FIG. 1 so that the clamping arms face inwardly in the bore 105. Further, the interior of the housing section 25C has been provided with a ramp 116 against which the beveled edge 115 of the camping arm 113 rides. The interior end of the cap 200 has been made blunt in order to engage the conductive clamp 112. Accordingly, with a cable positioned in the connector, longitudinal movement of the cap 200 into the bore 105 forces the clamping arms 113 to ride up the ramp 116 and radially inward so that the tips 133 pierce into the cable.

Figure 5:
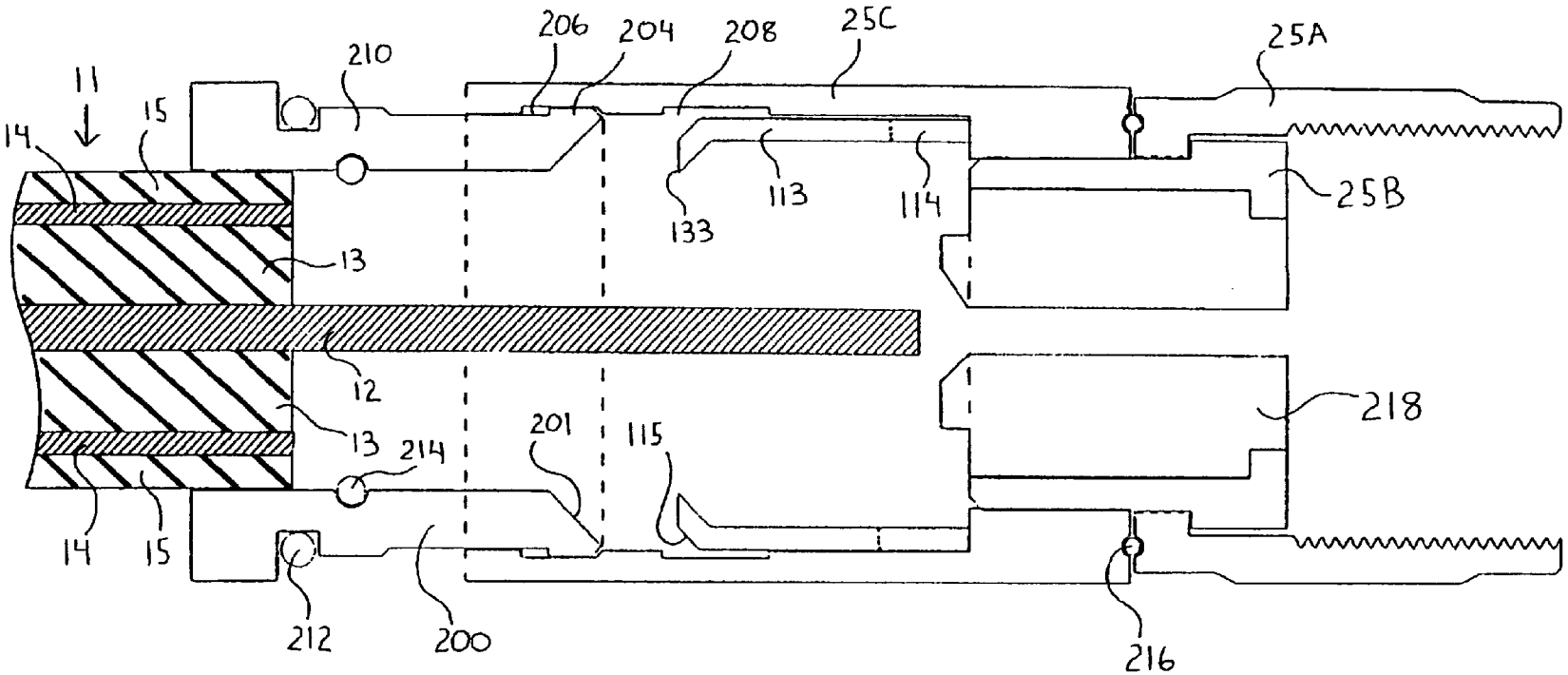
FIG. 5 shows an embodiment of the subject connector which utilizes the center conductor of the coaxial cable rather than a pin.

FIG. 5 shows an embodiment of the invention of FIG. 1 wherein the center pin 202 has been removed and the cable 11 has been cut back to expose a length of the center conductor 12 adequate for projecting through the insulator plug 218 into the open portion of the terminal housing 25A. Further, FIG. 5 shows an embodiment of the invention of FIG. 1 wherein the center pin 202 and the insulator plug 218 have been removed and the cable 11 has been cut back to expose a length of the center conductor 12 adequate for projecting into the open portion of the terminal housing 25A and the insulation layer 15 and conductive sheath 14 have been cut back to expose the insulation layer 13 of sufficient length to nest in the interconnecting section 25B and to electrically isolate the conductor 12 from the housing 25. In all other respects the configuration of FIGS. 4 and 5 function in the same manner as described relative to that of FIG. 1.

Figure 7:
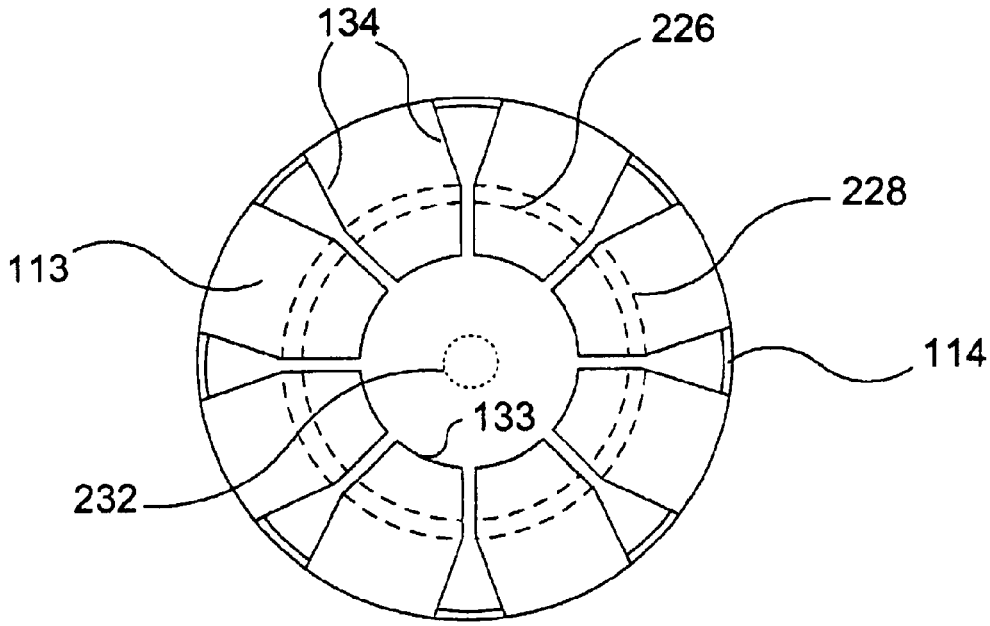
FIG. 7 shows an end view of an electrically conductive clamp in accordance with the subject invention having eight clamping arms which have been manipulated into the clamped position.

FIG. 7 shows an end view of an embodiment having eight clamping arms 113 extending from a collar 114, as shown in FIG. 1, which have been clamped into place. Clamping of arm 113 in order to drive tip 133 into the insulation can be accomplished, for example, with a special tool for reaching into housing 25C to urge arms 113 toward the cable, by pushing cap 200 into housing 25C, or by pressing arms 113 into the insulation by hand, with pliers, or with another tool prior to insertion of the end of the insulated conductor into the housing. Dashed lines 226 and 228 represents the edges of the beveled surface 115 of the clamping arms. Around the outside collar 114 can be seen through the spacings between arms 113.

Figure 6:
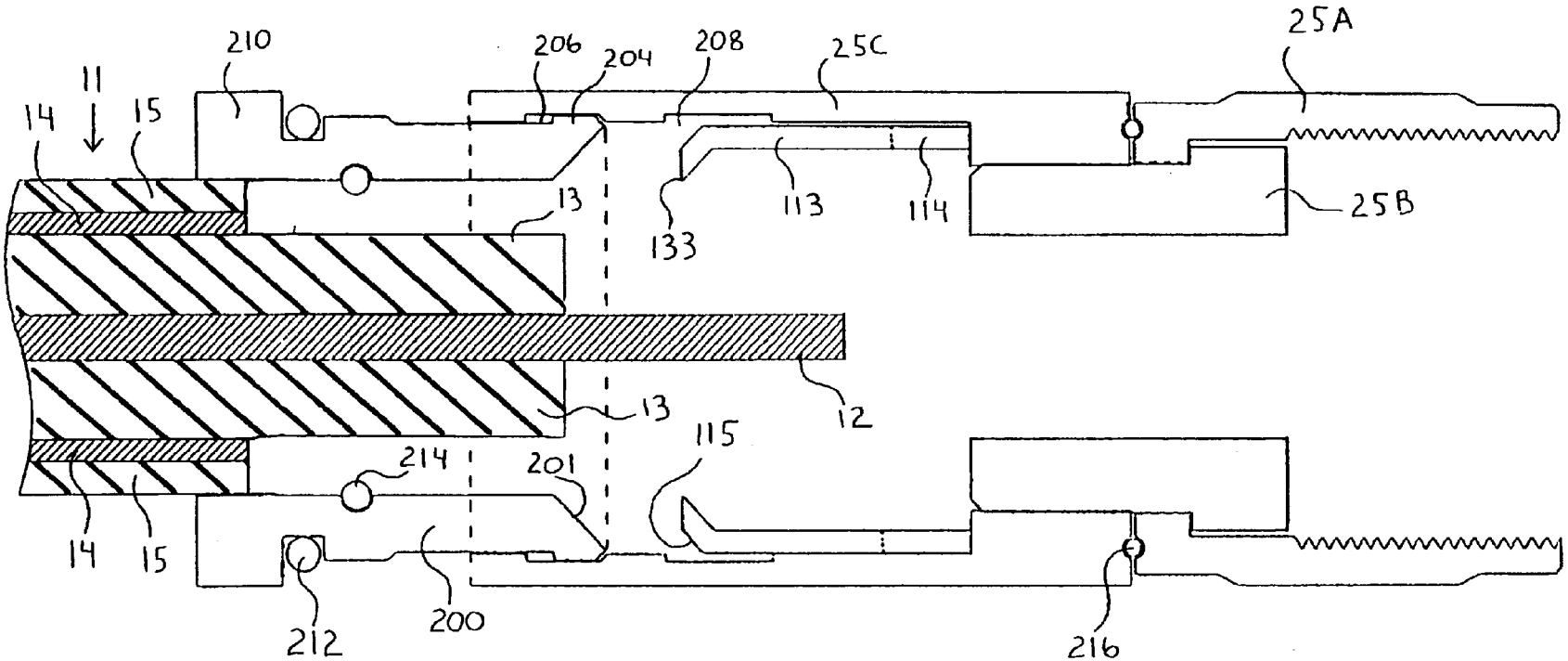
FIG. 6 shows an embodiment of the subject connector which utilizes the center conductor of the coaxial cable rather than a pin and the inner insulation of the coaxial cable to electrical isolate the center conductor of the coaxial cable from the housing.
Figure 8:
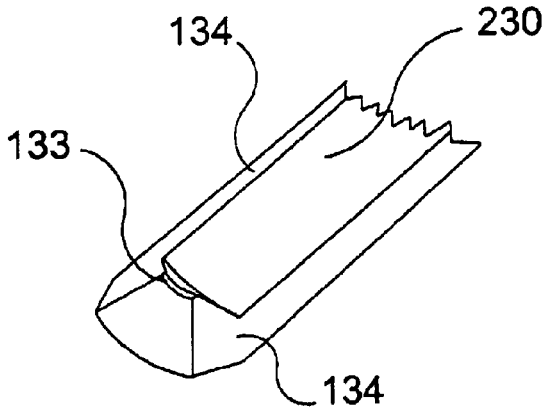
FIG. 8 shows a specific embodiment of an individual clamping arm broken away from the housing.

The curve of the end 133 can also be selected to optimize the performance of the connector. In FIG. 7, the curve of end 133 is selected such that the eight ends form a circular pattern of deepest penetration into the conductive sheath of the coaxial cable. The dotted circle 232 in the center of FIG. 6 represents the approximate location of the inner conductor of the coaxial cable. Referring to FIG. 8, a single clamping arm 113 broken away from collar 114 is shown. The pointed end 133 of clamping arm 113 can have a variety of shapes, in order to optimize one or more operational characteristics of the electrical connector. In the embodiment shown in FIG. 8, pointed end 133 is shaped such that as the clamping arms are manipulated to cause the piercing of the outer insulation, the sides 134 of the clamping arms come into contact with the adjacent clamping arms so as to prevent further penetration of the pointed end 133.

Figure 9B:
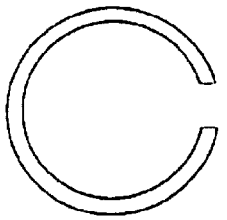
FIG. 9B shows an end cross-sectional view of the hollow portion of the pin shown in FIG. 9A.
Figure 9A:
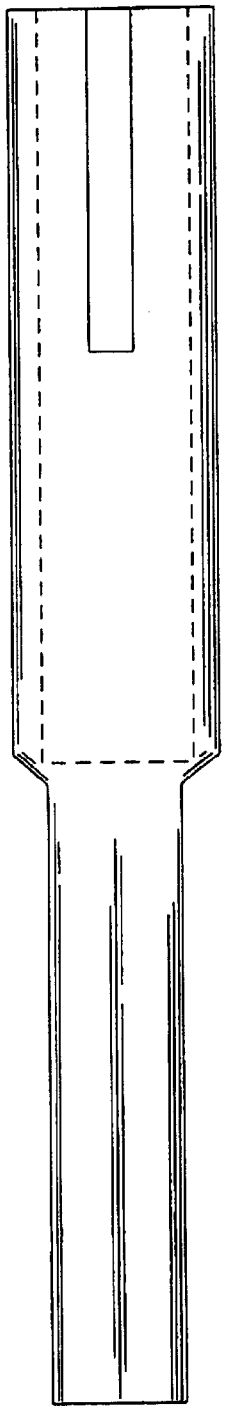
FIG. 9A shows a side view of a conductive pin in accordance with the subject invention, incorporating a hollow portion having a single slit.
Figure 10B:
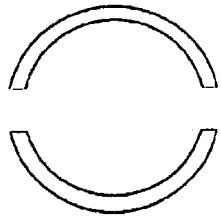
FIG. 10B shows an end cross-sectional view of the hollow portion of the pin shown in FIG. 10A.
Figure 10A:
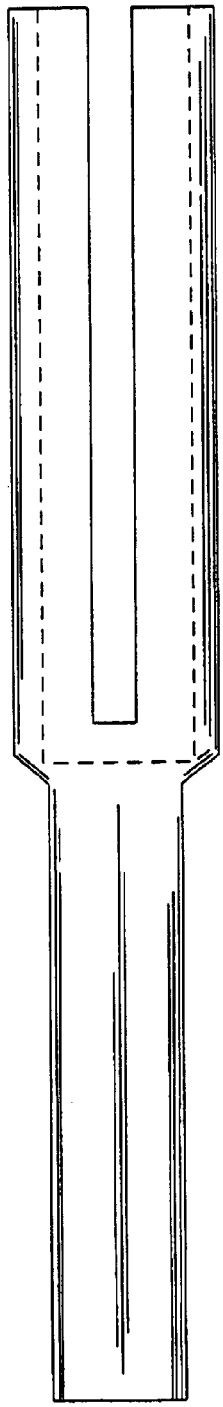
FIG. 10A shows a side view of a conductive pin in accordance with the subject invention, incorporating a hollow portion having two slits.

Referring to FIGS. 9A, 9B, 10A, and 10B, specific embodiments of a pin 202 which can be utilized with respect to the electrical connectors of the subject invention is shown. For example, either pin shown in FIGS. 9A and 10A, or variations thereof, can be incorporated with the electrical connectors shown in FIGS. 1–6. Both FIGS. 9A and 10A show side views of pins having a hollow portion on one end for receiving an electrical conductor and a solid portion for connecting with and an external apparatus on the other end. Other pin embodiments are possible which, for example, have a solid portion at each end of the pin or have a hollow portion at each end of the pin. In addition, the entire pin can be hollow if desired. Preferably, the hollow portion of each pin can have one or more slits. The number, lengths, and widths, of the slits can vary depending on the application. FIG. 9A shows a slit which extends about half the length of the hollow portion of the pin, while FIG. 10A shows two slits which extend essentially the entire length of the hollow portion of the pin. FIGS. 9B and 10B show end views of the hollow portions of the pins shown in FIGS. 9A and 10A, respectively. These slits can allow the hollow portion to expand to just the right size to receive an electrical conductor such that a good electrical contact can be made.

The present invention should not be construed as limited to the forms shown which are to be considered illustrative rather than restrictive.

What is claimed is:

1. A electrical connector for coupling to a coaxial cable having a center conductor enclosed in an inner insulation layer and a conductive sheath around the inner insulation layer and an outer insulation layer overlying the conductive sheath, comprising:

a housing having an axial bore therein with an inner periphery for receiving the coaxial cable in one end thereof, said housing being electrically conductive and having an insulator plug terminating the bore therein and acting as a stop for the coaxial cable received in the bore;

an electrically conductive clamp in the bore of said housing and electrically connected to said housing at the inner periphery thereof, said electrically conductive clamp having a pointed end shaped and sized for driving into the outer insulation layer of the coaxial cable to engage the conductive sheath thereof, and a cylindrical compression cap having an end wall apertured to receive the coaxial cable in passage to said electrically conductive housing and having a side wall with an outer periphery sized for engaging the inner periphery of said housing and shaped at an end of the side wall for engaging the pointed end of said electrically conductive clamp to drive the pointed end thereof toward the axis of the bore in said housing thereby to mechanically connect the coaxial cable to said housing and to electrically connect the conductive sheath of the coaxial cable to said housing through said conductive clamp, wherein the pointed end of said conductive clamp is ramp shaped and the end of the side wall of said cylindrical compression cap is complimentarily ramp shaped so that upon mutual engagement longitudinally along the axis of the said housing, the pointed end of said conductive clamp is driven radially toward the axis of said housing.

2. The electrical connector of claim 1 wherein the inner periphery of said housing and the outer periphery of said compression cap are threaded for longitudinal axial engagement.

3. The electrical connector of claim 1 wherein said insulating plug includes a center aperture for supporting an electrical conductor insulated from said electrically conductive housing.

4. The electrical connector of claim 3 wherein the center aperture of said insulating plug is adapted to receive and support the center conductor of a coaxial cable.

5. The electrical connector of claim 3 wherein the center aperture of said insulating plug is adapted to receive and support a conductive prong projecting into the bore of said housing for making electrical contact with the center conductor of a coaxial cable.

6. The electrical connector of claim 1 wherein the inner periphery of said housing and the outer periphery of said compression cap engage in a longitudinal axial interference fit.

7. The electrical connector of claim 6 wherein the inner periphery of said housing and the outer periphery of said compression cap are cooperatively ridged and grooved to interlock in a longitudinal axial interference fit.

8. The electrical connector of claim 7 wherein compression cap is of deformable material and the side wall of said compression cap is slotted between the point of interlock and the closed end thereof to deform radially toward the axis of the bore and to clamp on to the outer insulation layer of a coaxial cable.

9. An electrical connector for coupling to an insulated electrical conductor of a coaxial cable type having a center conductor enclosed in an inner insulation layer and a conductive sheath around the inner insulation layer which is enclosed in an outer insulation layer, comprising:

a housing having a first end for receiving an end of an insulated electrical conductor;

at least one clamping arm having a first end with a beveled edge for penetrating an outer insulation layer of the insulated electrical conductor;

a cap for insertion into said first end of said housing after an end of the insulated electrical conductor is inserted into said first end of said housing, wherein said at least one clamping arm is positioned within said housing such that once the end of the insulated electrical conductor is inserted into said housing, the insertion of said cap into the first end of said housing causes said first end of said at least one clamping arm to penetrate through the outer insulation layer to make electrical contact with the outer conductor of the insulated electrical conductor, wherein as the cap is inserted into the first end of the said housing, the cap pushes said at least one clamping arm such that the beveled edge of said at least one clamping arm interacts with a beveled edge on the housing such as to cause the first end of said at least one clamping arm to penetrate the outer insulation layer and make electrical contact with the outer conductor of the insulated electrical conductor.

10. An electrical connector for coupling to an insulated electrical conductor of a coaxial cable type having a center conductor enclosed in an inner insulation layer and a conductive sheath around the inner insulation layer which is enclosed in an outer insulation layer, comprising:

a housing having a first end for receiving an end of an insulated electrical conductor;

at least one clamping arm having a first end shaped for penetrating an outer insulation layer of the insulated electrical conductor, wherein said at least one clamping arm is positioned within said housing, a cap for insertion into said first end of said housing after an end of the insulated electrical conductor is inserted into said first end of said housing, beveled ring; and compression ring, wherein inserting the cap into the first end of the housing causes the cap to push the compression ring such that the compression ring contacts and pushes said beveled ring such that a beveled edge of the beveled ring engages said at least one clamping arm causing the first end of said at least one clamping arm to penetrate the outer insulation layer and make electrical contact with the outer conductor of the insulated electrical conductor.

11. The electrical connector according to claim 10, wherein the housing has a groove adapted to receive a discrete protrusion on the beveled ring, wherein the discrete protrusion is guided by the groove as the beveled ring is pushed by the compression ring, and wherein the discrete protrusion and groove prevent the beveled ring from rotating with respect to the housing.

12. An electrical connector for coupling to an insulated electrical conductor of a coaxial cable type having a center conductor enclosed in an inner insulation layer and a conductive sheath around the inner insulation layer which is enclosed in an outer insulation layer, comprising:

a housing having a first end for receiving an end of the insulated electrical conductor;

at least one clamping arm having a first end shaped for penetrating an outer insulation layer of the insulated electrical conductor;

a cap for insertion into said first end of said housing after an end of the insulated electrical conductor is inserted into said first end of said housing, wherein said at least one clamping arm is positioned within said housing such that once the end of the insulated electrical conductor is inserted into said housing, the insertion of said cap into the first end of said housing causes said first end of said at least one clamping arm to penetrate through the outer insulation layer and to make electrical contact with the outer conductor of the insulated electrical conductor; and an insulation section attached to the housing, wherein the insulation section has an aperture for receiving a protruding center conductor of the insulated electrical conductor, where said housing and insulation section is adapted to receive the end of the insulated electrical conductor which has a portion of the center conductor protruding from an otherwise flush end of the insulated electrical conductor such that the protruding center conductor passes through the aperture in the insulation section and protrudes into a second end of the connector, and where the insulation section electrically insulates the center conductor from the housing.

13. An electrical connector for coupling to an insulated electrical conductor of a coaxial cable type having a center conductor enclosed in an inner insulation layer and a conductive sheath around the inner insulation layer which is enclosed in an outer insulation layer, comprising:

a housing having a first end for receiving an end of an insulated electrical conductor;

at least one clamping arm having a first end shaped for penetrating an outer insulation layer of the insulated electrical conductor, a cap for insertion into said first end of said housing after an end of the insulated electrical conductor is inserted into said first end of said housing, wherein said at least one clamping arm is positioned within said housing such that once the end of the insulated electrical conductor is inserted into said housing, the insertion of said cap into the first end of said housing causes said first end of said at least one clamping arm to penetrate the outer insulation layer and to make electrical contact with the outer conductor of the insulated electrical conductor; and an insulation section having an aperture therethrough, and an electrically conductive pin located in the aperture of the insulation section such that the pin protrudes into the first end of the connector and protrudes into a second end of the connector, wherein the center conductor of the insulated electrical conductor makes electrical contact with the pin protruding into the first end of the connector as the end of the insulated electrical conductor is inserted into the first end of the connector.

14. The electrical connector according to claim 13, wherein the pin has a solid portion protruding into the first end of the connector for contacting the center conductor of the insulated electrical conductor.

15. The electrical connector according to claim 13, wherein the pin has a hollow portion protruding into the first end of the connector for receiving a solid center conductor.

16. The electrical connector according to claim 15, wherein the hollow portion of the pin has at least one slit allowing the hollow portion to expand as a solid center conductor enters the hollow portion.

17. An electrical connector for coupling to an insulated electrical conductor of a coaxial cable type having a center conductor enclosed in an inner insulation layer and a conductive sheath around the inner insulation layer which is enclosed in an outer insulation layer, comprising:

a housing having a first end for receiving an end of an insulated electrical conductor;

at least one clamping arm having a first end shaped for penetrating an outer insulation layer of the insulated electrical conductor; and a cap for insertion into said first end of said housing after an end of the insulated electrical conductor is inserted into said first end of said housing, wherein the cap comprises at least one protrusion which provides strain relief when the cap is inserted into the first end of the connector while the end of the insulated electrical connector is inserted in the first end of the connector, wherein said at least one clamping arm is positioned within said housing such that once the end of the insulated electrical conductor is inserted into said housing, the insertion of said cap into the first end of said housing causes said first end of said at least one clamping arm to penetrate the outer insulation layer and to make electrical contact with the outer conductor of the insulated electrical conductor.

18. The electrical connector according to claim 17, wherein the cap comprises at least one slot which allows the cap to compress when inserting the cap into the first end of the housing.

19. An electrical connector for coupling to an insulated electrical conductor, comprising:

a housing having an open end for receiving an end of the insulated electrical conductor;

means for penetrating an outer insulation layer of the insulated electrical conductor, the means for penetrating being disposed within the housing;

means for inserting an insulated electrical conductor into the open end of the housing such that the means for penetrating surrounds the insulated electrical conductor; and means for urging the penetration means, said means for urging being slidably pushed into the open end of the housing after the penetration means surrounds the insulated electrical conductor to force the penetration means to penetrate the outer insulation layer of the insulated electrical conductor.

20. The electrical connector according to claim 19, wherein a first end of the means for penetrating has a beveled edge, wherein the means for urging has a beveled edge, as said means for urging is inserted into the open end of said housing, the beveled edge of said means for urging pushes the beveled edge of said means for penetrating to cause the first end of said means for penetrating to penetrate into the outer insulation layer of the insulated conductor.

21. An electrical connector for coupling to an insulated electrical conductor, comprising:

a housing having an open end for receiving an end of an insulated electrical conductor;

means for inserting the insulated electrical conductor into the open end of the housing;

at least one clamping arm for penetrating the insulated electrical conductor, the at least one clamping arm being disposed within the housing so as to surround the insulated electrical conductor as it is inserted in the housing; and means for engaging the at least one clamping arm, wherein insertion of the means for engaging the at least one clamping arm into the open end of the housing causes the at least one clamping arm to penetrate the outer insulation layer of the insulated electrical conductor, said housing being configured to receive an end of the insulated electrical conductor which has a protruding portion of an inner insulation layer and a protruding portion of a center conductor both protruding from an otherwise flush end of the insulated electrical conductor, and the protruding portion of the center conductor protruding from the protruding portion of the inner insulation layer such that the protruding portion of the inner insulation layer acts to electrically insulate the center conductor from the housing, and the protruding portion of the center conductor protruding into a second end of the connector.

22. The electrical connector according to claim 21, wherein said at least one clamping arm is integral with the housing.

23. The electrical connector according to claim 21, wherein a first end of said at least one clamping arm has a beveled edge, wherein as said engaging means is inserted into the open end of said housing, a beveled edge of said engaging means pushes the beveled edge of said at least one clamping arm to cause the first end of said at least one clamping arm to penetrate an outer insulating layer of the insulated electrical conductor.

24. The electrical connector according to claim 21, wherein the engaging means threadably engages the open end of the housing, such that insertion of the engaging means is caused by threading the engaging means with respect to the open end of the housing.

25. The electrical connector according to claim 21 wherein said engaging means is adapted to be slidably pushed into said open end of said housing.

* * * * *